United States Patent [19]

Chihara

[11] 4,182,108

[45] Jan. 8, 1980

[54] ELECTRONIC TIMEPIECE CORRECTION CIRCUIT

[75] Inventor: Hiroyuki Chihara, Suwa, Japan

[73] Assignee: Kabushiki Kaisha Suwa Seikosha, Tokyo, Japan

[21] Appl. No.: 776,083

[22] Filed: Mar. 9, 1977

[30] Foreign Application Priority Data

Mar. 9, 1976 [JP] Japan ..... 51-25334

[51] Int. Cl.[2] ..... G04B 19/24; G04C 3/00; G04B 27/00

[52] U.S. Cl. ..... 58/4 A; 58/23 R; 58/58; 58/85.5

[58] Field of Search ..... 58/4 A, 23 R, 50 R, 58/58, 85.5

[56] References Cited

U.S. PATENT DOCUMENTS

| | | | |
|---|---|---|---|
| 3,839,856 | 10/1974 | Dargent | 58/4 A |
| 3,943,696 | 4/1976 | Portmann et al. | 58/85.5 |
| 4,033,108 | 7/1977 | Bennett | 58/23 R |

FOREIGN PATENT DOCUMENTS

| | | | |
|---|---|---|---|
| 1419252 | 12/1975 | United Kingdom | 58/23 R |

*Primary Examiner*—Edith S. Jackmon

*Attorney, Agent, or Firm*—Blum, Kaplan, Friedman, Silberman and Beran

[57] ABSTRACT

An electronic timepiece correction circuit for a digital display electronic timepiece wherein the same digital display is utilized with timekeeping circuitry capable of producing two types of time information to display both types of time information is provided. Mode select circuitry that is coordinately disposable between a timekeeping mode and a correction mode is disposed intermediate a manually actuatable control circuit and the timekeeping circuitry and digital display. When the mode select circuitry is disposed in a timekeeping mode, actuation of the control circuitry will result in the digital display changing from a display of the first type of time information to a display of the second type of time information produced by the timekeeping circuitry. However, when the mode select circuitry is in a correction mode, the mode select circuitry will select the particular timekeeping circuitry to be corrected, and if the timekeeping circuitry to be corrected is producing the second type of time information, the mode select circuitry will change over the digital display from the display of the first type of time information to the second type of time information.

12 Claims, 10 Drawing Figures

| SWITCH 1 | BUTTON 2 | BUTTON 3 | CHANNEL | MODE | DISPLAY |
|---|---|---|---|---|---|
| L | L | | MAIN | NORMAL | HOUR, MINUTE, SECOND |
| L | H | | SUB | " | MONTH, DAY |
| L | L | | MAIN | " | HOUR, MINUTE, SECOND |
| H | L | I | " | SECOND SELECTION CORRECTION | HOUR, MINUTE, SECOND |
| H | ↑ | I | " | MINUTE " | HOUR, MINUTE, SECOND |
| H | ↑ | I | " | HOUR " | HOUR, MINUTE, SECOND |
| H | ↑ | I | " | SECOND " | HOUR, MINUTE, SECOND |
| H | ↑ | I | " | MINUTE " | HOUR, MINUTE, SECOND |
| L | L | | " | NORMAL | HOUR, MINUTE, SECOND |
| L | H | | SUB | " | MONTH, DAY |
| H | H | I | " | DAY SELECTION CORRECTION | MONTH, DAY |
| H | ↑ | I | " | MONTH " | MONTH, DAY |

FIG. 3
PRIOR ART

| SWITCH 1 | BUTTON 2 | BUTTON 3 | CHANNEL | MODE | DISPLAY |
|---|---|---|---|---|---|
| L | L | | MAIN | NORMAL | HOUR, MINUTE, SECOND |
| L | H | | SUB | " | MONTH, DAY |
| L | L | | MAIN | " | HOUR, MINUTE, SECOND |
| H | L | I | " | SECOND SELECTION CORRECTION | HOUR, MINUTE, SECOND |
| H | ↑ | I | " | MINUTE " | HOUR, MINUTE, SECOND |
| H | ↑ | I | " | HOUR " | HOUR, MINUTE, SECOND |
| H | ↑ | I | SUB | DAY " | MONTH, DAY |
| H | ↑ | I | " | MONTH " | MONTH, DAY |
| H | ↑ | I | MAIN | SECOND " | HOUR, MINUTE, SECOND |
| H | ↑ | I | " | MINUTE " | HOUR, MINUTE, SECOND |

FIG. 4

ELECTRONIC TIMEPIECE CORRECTION CIRCUIT

BACKGROUND OF THE INVENTION

The instant invention is directed to an electronic timepiece correction circuit for a digital display electronic timepiece, and in particular to electronic timepiece correction circuitry wherein the same display digits of a digital display are utilized to display two different types of time information produced by the electronic timepiece timekeeping circuitry.

As a result of the dramatic advances that have taken place in recent years in the development of semiconductor integrated circuitry, in particular, with respect to the miniaturization of the electronic circuitry performed thereby, more accurate and smaller sized digital display electronic wristwatches have been provided. Additionally, better minizaturization has resulted in an increase in the type of information that can be measured and displayed by the electronic wristwatch. In addition to displaying hours, minutes and seconds, electronic wristwatches have also been provided with calendar displays such as month, date and day of the week displays. Nevertheless, the small size of the electronic timepiece limits the space in which the digital display can be provided, thereby rendering it particularly difficult to simultaneously display each of the types of information that are counted by the timekeeping circuitry. Accordingly, the same display digits are utilized to display different types of information, by providing the wristwatch with a changeover switch, which changeover switch permits the digital display to display more than one type of information. For example, a changeover switch can be utilized to changeover the digital display from displaying clock information such as seconds, minutes and hours to display calendar information such as the date and month.

Timepieces that are capable of having the display changed over from a main-display channel, wherein the seconds, minutes and hours are displayed to a sub-display channel wherein other types of information such as calendar information are displayed are, however, difficult to correct. Specifically, because the main-display channel effects a display of one type of specific information and, thus, is isolated from the sub-display channel, when correction of the time information or, alternatively, the calendar information is required, the changeover switch will select either the main-display channel or, alternatively, the sub-display channel to thereby permit only correction of the timekeeping circuitry associated with the time displayed in the particular main-display channel or sub-display channel. However, if the electronic timepiece is in a correction mode, and it is determined that both types of information displayed by the display digits need correction, after correction of the type of information displayed in either the main-display channel or sub-display channel is effected, the timepiece must be returned from a correction mode to a normal timekeeping mode, in order to permit the other display channel to be selected, whereafter the timepiece can be once again disposed in a correction mode to effect correction of the second type of time information. Thus, when both types of time information need to be corrected, such as when the battery is replaced, such correction is difficult and unwieldy. Accordingly, the instant invention is directed to an electronic timepiece correction circuitry for permitting changeover from the digits of time displayed by the main-display channel to the digits of time displayed by the sub-display channel when the timepiece is in a correction mode.

SUMMARY OF THE INVENTION

Generally speaking, in accordance with the invention, an electronic timepiece correction circuit for a digital display timepiece, wherein the same digital display is utilized with timekeeping circuitry capable of producing two types of time information in order to display both types of time information, is provided. The electronic timepiece includes time standard circuitry for producing a time standard signal and a plurality of series-connected counters for receiving the time standard signal, each of the series-connected counters being adapted to produce a timekeeping signal representative of the count thereof. A digital display is adapted to display a first type of time information in response to at least two of the timekeeping signals produced by the first and second series-connected counters being applied thereto. The digital display is further adapted to display a second type of time information in response to at least one further timekeeping signal produced by a third series-connected counter being applied thereto. Display select circuitry is disposed intermediate the series-connected counters and the digital display, the display select circuitry being normally disposed in a first display mode and selectively disposable into a second display mode in response to a changeover signal being applied thereto. The display select circuitry is adapted in a first display mode to apply to the digital display the timekeeping signals produced by the first and second series-connected counters and is further adapted in a second display mode to apply to the digital display the at least one further timekeeping signal produced by the third counter means. The instant invention is particularly characterized by control circuitry for selectively producing a control select signal, adjustment circuitry for producing an adjustment signal and mode select circuitry coupled intermediate the control circuitry and adjustment circuitry and the series-connected counters and display select circuitry. The mode select circuitry is coordinately disposable between a first mode and a second mode, and is adapted when disposed in the first mode to apply to the display select circuitry a changeover signal in response to the control signal being selectively applied thereto. The mode select circuitry is further adapted when disposed in a second mode to select either the first, second or third series-connected counter and apply thereto the adjustment signal produced by the adjustment circuitry. Also, when the mode select circuitry is in a second mode, it is further adapted when the third series-connected counter is selected to apply a changeover signal to the display select circuitry.

Accordingly, it is an object of the instant invention to provide improved correction circuitry for an electronic liquid crystal digital display wristwatch.

A further object of the instant invention is to provide an improved electronic timepiece correction circuit for a digital display timepiece wherein the same liquid crystal digital display is utilized to display two types of time information.

Still a further object of the instant invention is to provide electronic timepiece correction circuitry for a digital display timepiece wherein the digital display is utilized to display two types of time information, and wherein changing over from correcting a first type of time information to correcting a second type of time information can be effected without returning the timepiece from a correction mode to a timekeeping mode.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a table illustrating the operation of the digital display electronic timepiece depicted in FIG. 1;

FIG. 4 is a table illustrating the operation of a digital display electronic wristwatch constructed in accordance with a preferred embodiment of the instant invention;

DETAILED DESCRIPTION OF THE PREFERRED EMBODIMENTS

Figure 1:
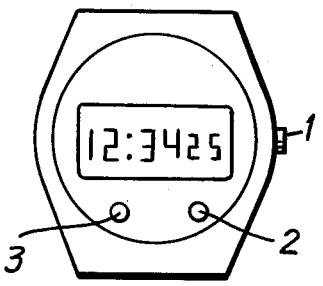
FIG. 1 PRIOR ART
FIG. 1 is a plan view of a digital display electronic wristwatch constructed in accordance with the prior art.

Reference is now made to FIG. 1, wherein a digital display electronic wristwatch, having a liquid crystal digital display, is depicted. The wristwatch includes a correction-locking switch 1, which switch is adapted to be pushed in from a locked position to effect a changeover from a display of seconds, minutes and hours to a display of calendar information or pulled out from a locked position to effect correction of the time or calendar information displayed by the electronic timepiece. Push button 2 is a control switch, and is prevented from performing control functions when the correction-locking switch 1 is disposed in a locked position. Accordingly, when correction-locking switch 1 is pushed in, control switch 2 operates solely as a changeover switch and, in response to the pushing of same, effects a display of calendar information, by selecting a sub-display channel. When locking-correction switch 1 is pulled out, the electronic timepiece is disposed in a correction mode, so that the control switch 2 can select the digits of time to be corrected in the display channel that is being displayed at the time that the correction-locking switch 1 is pulled out.

Figure 2:
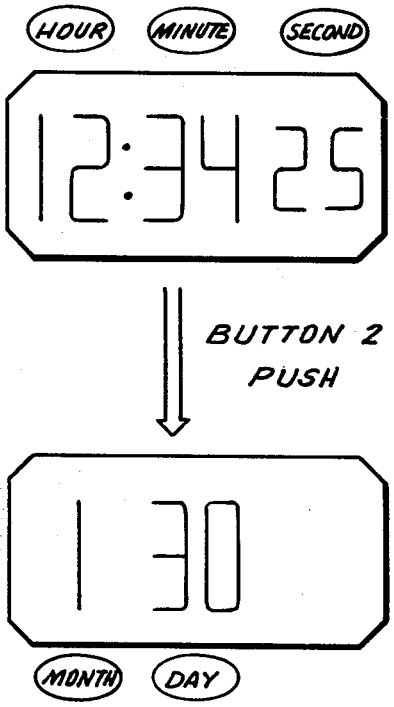
FIG. 2 is a illustrative view of the manner in which the digital display wristwatch, depicted in FIG. 1, is changed over from the display of time information to the display of calendar information.

FIG. 2 illustrates the manner in which the digital display is changed over from a main-display channel wherein hours, minutes and seconds are displayed to a sub-display channel wherein the month and day of the month are displayed, when push button switch 2 is actuated. As noted above, a changeover from the main-display channel to the sub-display channel can only be effected when the correction-locking switch 1 is pushed in, and the sub-display channel is only displayed for the period that control push button switch 2 is actuated. Accordingly, display of calendar information is effected in a manner known in the art as "demand display".

Reference is now made to FIG. 3, wherein a table illustrating the display modes and correction modes of the prior art digital display electronic wristwatch, depicted in FIGS. 1 and 2, is illustrated. In the table, the designation "L" for Switch 1 represents when the correction-locking switch 1 is pushed in, and the designation "H" represents when the correction-locking switch 1 is pulled out. The designation "L" for push button 2 represents when the control switch is not being actuated, the designation "H" represents when the push button 2 is being actuated (pushed) and the "↑" represents when the push button 2 has been actuated and the correction-locking switch 1 is pulled out. The designation "I" for push button 3, represents when the push button 3 is actuated and an Index pulse is applied to index the count of the time display that is being corrected.

With reference to FIG. 2, the time information circled, such as seconds, minutes, hours, month and date, represents the digit of time described in the "Mode" column of the table depicted in FIG. 3, and when the particular digit of time is selected, the digit is flickered in a manner well known in the art.

The table in FIG. 3 illustrates the manner in which the correction-locking switch 1, control push button 2 and correction push button 3 effect correction and changeover of the display of an electronic wristwatch constructed in accordance with the prior art. Specifically, when the correction-locking switch is pushed in (L), the main-display channel continues to be displayed, until control push button 2 is actuated (H) to thereby effect a selection of the sub-display channel and hence a display of the month and day time information. However, when the correction-locking switch is pulled out (H), and the control push button 2 is not being actuated (L) at that time, the main-display channel is selected, thereby providing a display of seconds, minutes and hours, and the seconds digit is flickered, thereby designating that same is selected for correction. Correction of the seconds digits is thereby effected by the actuation (I) of correction push button 3, to thereby effect an indexing of the count of the seconds display by one for each actuation thereof. It is noted that arrangements have been provided whereby the seconds display is reset to zero instead of being indexed by a count of one, when correction of the seconds display is selected. While the timepiece is in a correcton mode, and the seconds display of the main-display channel is selected for correction, actuation (↑) of the control push button 2, will result in a selection of the minutes digits for correction, and a corresponding flickering of the digits at that time. If correction of the minutes digits is desired, actuation (I) of the correction push button 3 is effected, and for each actuation (I) of the push button 3, the minutes display digits are indexed by a count of one. Similarly, the further actuation (↑) of control push button 2 will effect a selection of the hours display digit, whereupon correction of the hours display digits can be effected in the same manner described above with respect to the minutes and seconds display digits. Finally, a further actuation of control push button 2 will result in a selection of the seconds digits, and accordingly, selection of the seconds, minutes and hours digit is cyclically and sequentially effected in response to each actuation (↑) of the control push button 2 when the main display channel is selected and the timepiece is disposed in a correction mode.

However, if it is necessary to correct the time information displayed in the sub-display channel, first the correction-locking switch must be pushed in. Thereafter, the control push button must be actuated (H) to thereby select the sub-display channel, and during the period that the sub-display channel is selected, the correction-locking switch 1 must be pulled out (H) in order to dispose the electronic timepiece in a correction mode whereby the month and day will be displayed, and the day digits will be flickered, thereby designating that same have been selected to be corrected. Thereafter, each actuation (I) of control push button 3, will result in an indexing of the count of the day digit being corrected. Once correction of the day digit is completed, actuation (↑) of the control push button 2 will result in a selection of the month digits, whereafter correction of same can be effected in the same manner as the day digits.

It is apparent from the foregoing description that correction of the display digits, in the main-display channel and also the display digits in the sub-display channel, is difficult and awkward since it requires a return of the timepiece from a correction mode to a normal timekeeping mode in order to changeover from one display channel to the other display channel in order to effect correction of the display digits associated with the particular display channel. In addition to this inconvenience and awkwardness, additional awkwardness is provided by the "demand type" method required to obtain selection of the sub-display channel for correction. If only the digits of time, in the sub-display channel require correction, it is still necessary to first push in the correction-locking switch, actuate the control push button 2 and continue to actuate the control push button 2, until the correction -locking switch 1 is pulled out to select the sub-display channel for correction. Although a further changeover switch could be provided for changing over the main-display channel to the sub-display channel when the timepiece is in a correction mode, such an arrangement would require an additional changeover switch to be provided, a result which should be avoided in the designing of a small-sized electronic wristwatch.

As is detailed below, the instant invention is characterized by the elimination of the difficulties and awkwardness attendant to prior art digital display electronic wristwatches by permitting each of the digits of time in both the main-display channel and sub-display channel to be sequentially and cyclically selected when the electronic timepiece is in a correction mode, with the automatic selection of the display digits corresponding to the timekeeping circuitry producing the timekeeping signals for energizing the sub-display channel when the digits of time, in the sub-display channel, are sequentially selected. Such a construction will clearly eliminate the necessity of changing over the digital display from a main-display channel to a sub-display channel when correction of the digits, associated with both display channels, is effected.

Figure 9:
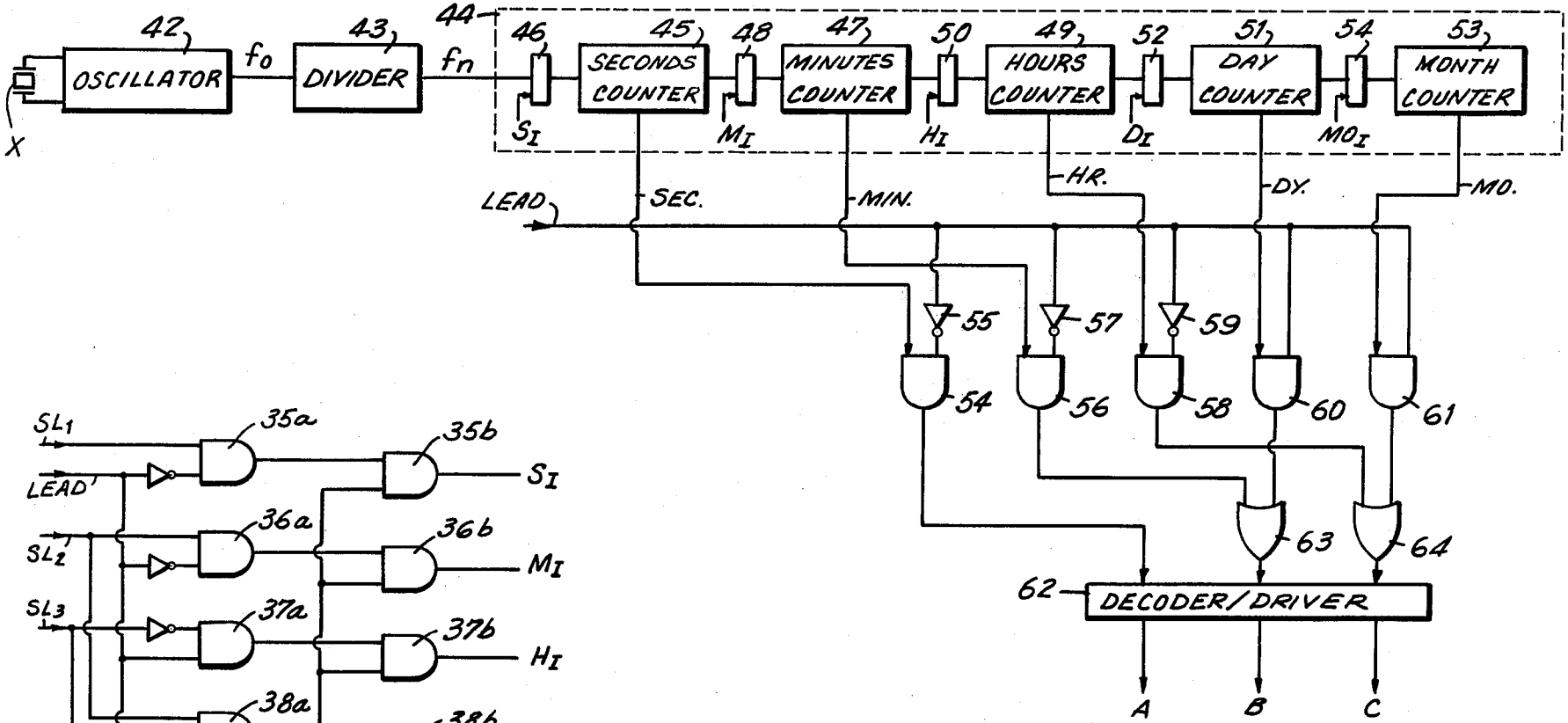
FIG. 9 is a block circuit diagram of an electronic timepiece circuit utilizable with the mode select circuit depicted in FIG. 5.

Turning now to FIG. 9, an electronic timepiece circuit of the type to which the improved electronic timepiece correction circuitry of the instant invention is directed, is depicted. The electronic timepiece includes an oscillator circuit 42 having, as a time standard, a quartz crystal vibrator X capable of oscillating at frequencies of at least $2^{16}$ Hz, in order to produce a high frequency time standard signal $f_O$. The high frequency time standard signal $f_O$ is applied to a divider circuit 43, which divider circuit is formed of at least sixteen series-connected binary divider stages for dividing down the high frequency time standard signal $f_O$ and thereby produce a low frequency time standard signal $f_n$ having a frequency of one Hz. The low frequency time standard signal $f_n$ is applied to counter circuit 44, which counter circuit is provided with a plurality of series-connected counters for producing timekeeping signals representative of the count thereof. Counter circuit 44 includes a seconds counter 45, minutes counter 47, hours counter 49, day counter 51 and month counter 53, having correction circuits 46, 48, 50, 52 and 54 disposed at the input of each of said counters for permitting the count thereof to be corrected in response to a correction signal applied thereto. In the absence of a correction signal being applied to the respective correction circuits 46, 48, 50, 52 and 54, each of the timekeeping counters 45, 47, 49, 51 and 53 are series-connected and respectively produce a seconds timekeeping signal SEC., minutes timekeeping signal MIN., hours timekeeping signal HR., day timekeeping signal DY., and month timekeeping signal MO., representative of the count thereof. The digital display is identical to the digital display illustrated in FIG. 2, and hence a display select circuit comprised of AND gates 54, 56, 58, 60 and 62, inverters 55, 57 and 59 and OR gates 63 and 64 are adapted to apply to the decoder-driver circuit 62 either the timekeeping signals SEC., MIN. and HR. when the display select circuit selects a main display channel or, alternatively, the timekeeping signals DY. and MO. when the display select circuitry selects the sub-display channel. As will be explained in greater detail below, when the changeover signal LEAD is a LOW level binary signal, the timekeeping signals SEC., MIN. and HR. are transmitted to the decoder/driver circuit 62 by the display select circuitry and are in turn transmitted to the display digits as display signals A, B and C respectively. Alternatively, when the changeover signal LEAD is a HIGH binary level signal, timekeeping signals DY. and MO. are transmitted through the display select circuit to the decoder/driver circuit 62, and are, in turn, applied as display drive signals B and C to the appropriate display digits.

Figure 5:
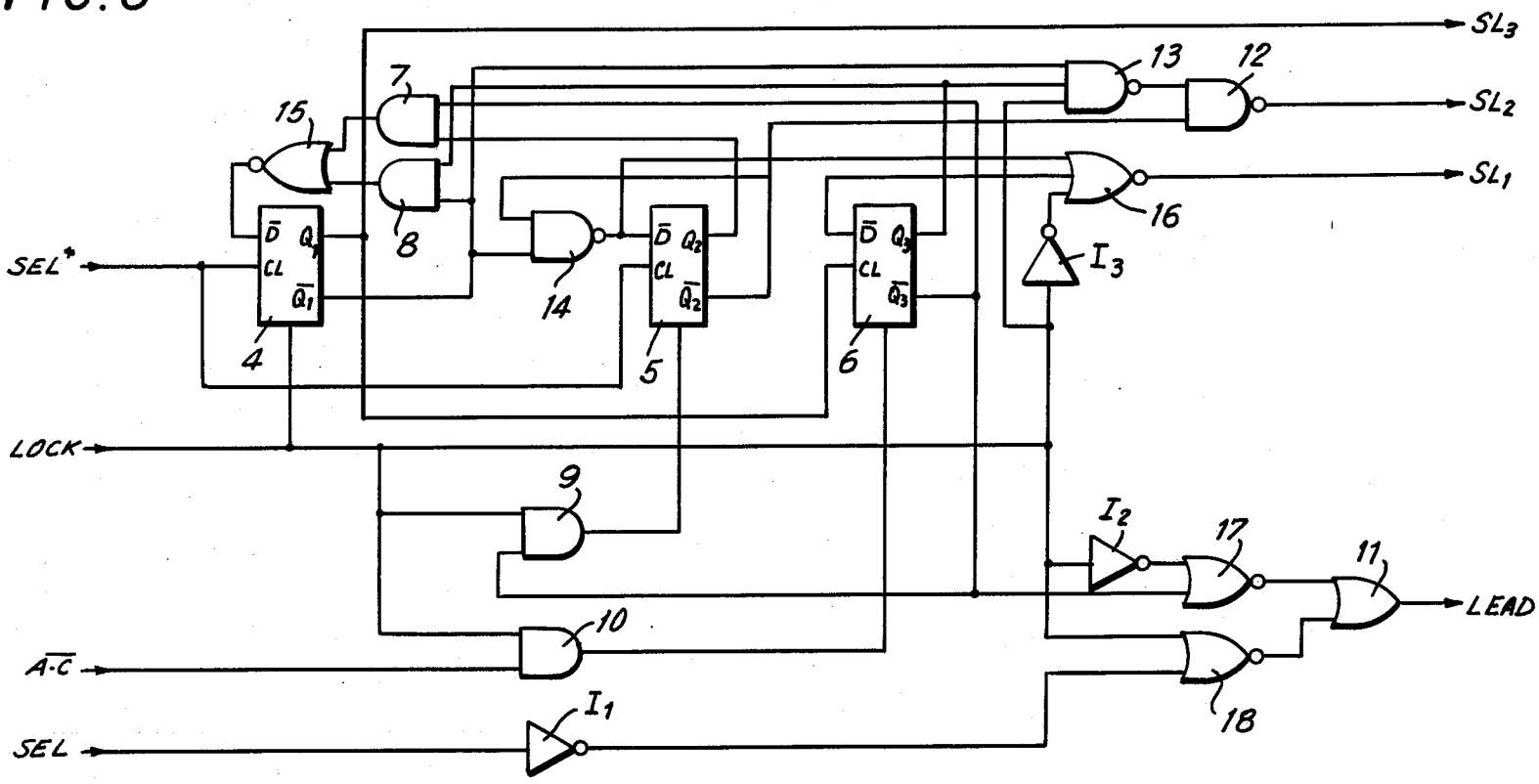
FIG. 5 is a circuit diagram of a mode select circuit constructed in accordance with a preferred embodiment of the instant invention.
Figure 6:
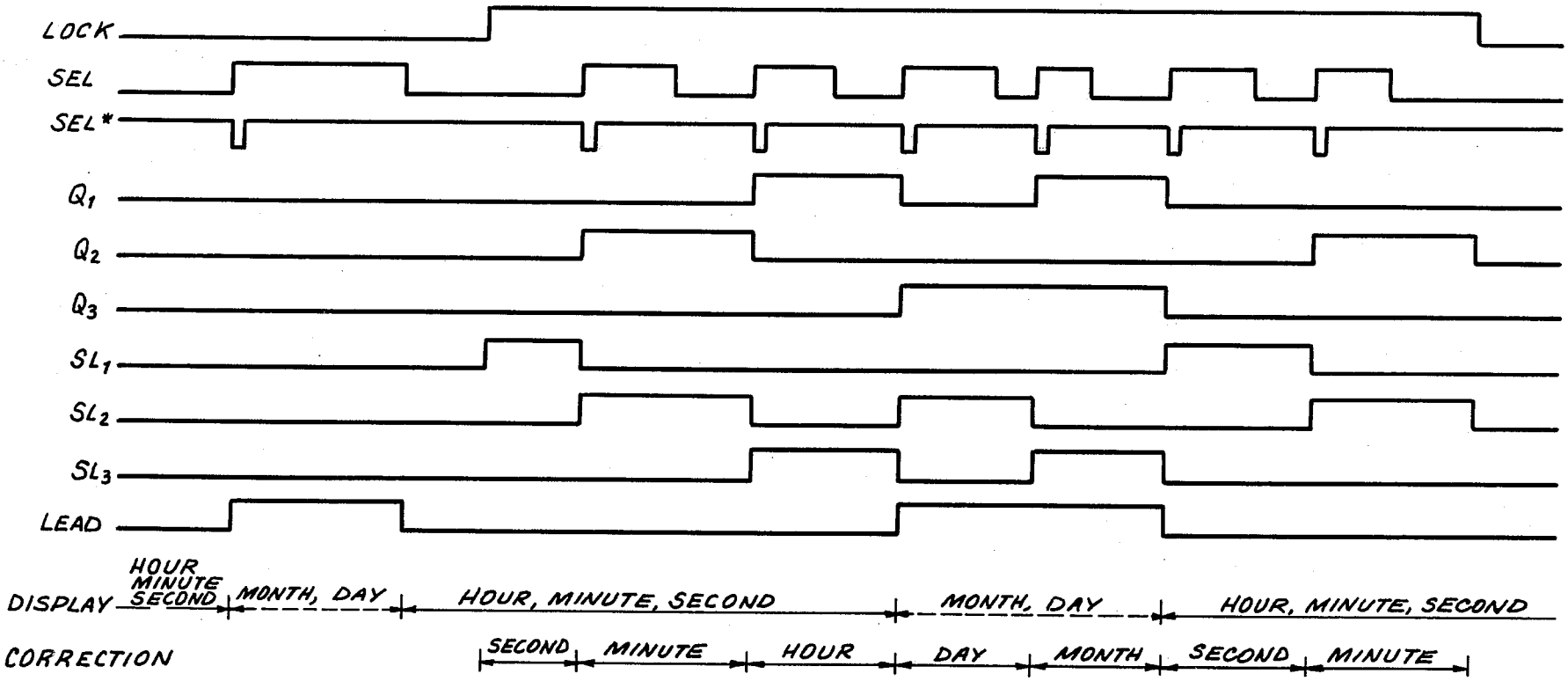
FIG. 6 is a comparative wave diagram illustrating the operation of the mode select circuit depicted in FIG. 5.

Reference is now made to FIG. 5, wherein the mode select circuit utilized to select the digits to be corrected and automatically change the digital display from displaying a main-display channel to a sub-display channel, and FIG. 6, wherein a comparative wave diagram illustrating the operation of the mode select circuit, depicted in FIG. 5, are illustrated. The signal LOCK represents the signal produced by the correction-locking switch 1, and is a LOW level signal when the correction-locking switch is pushed in, and a HIGH level signal when the correction-locking switch 1 is pulled out. SEL is the signal produced by the push button 2 and is a LOW level signal when the push button is not actuated, and is a HIGH level signal when the control push botton 2 is actuated. Signal SEL* is a signal produced by control push button 2 and is usually referenced to a HIGH level, except when control push button 2 is first actuated. Signal SEL* can be formed by disposing a D-type flip-flop intermediate the push button control switch in order to produce a pulse whenever the control push button switch 2 is actuated. Signal $\overline{A.C}$ is an auto-clear signal which is normally referenced to a HIGH level. As noted above, with respect to the display select circuitry of the timepiece, the signal LEAD is a channel select signal and is a LOW level signal when the main-display channel is selected, and is a HIGH level signal when the sub-display channel is selected. Timekeeping counter select signals $SL_1$, $SL_2$ and $SL_3$ are normally referenced at a LOW level and are only referenced at a HIGH level when they are utilized to select a timekeeping counter to be corrected. As will be explained in greater detail below, timekeeping select signals $SL_1$, $SL_2$ and $SL_3$ correspond to the selection of the seconds, minutes and hours timekeeping counters when the channel select signal LEAD is a LOW level signal and timekeeping select signals $SL_2$ and $SL_3$ correspond to the day counter and month counter when the channel select signal LEAD is a HIGH level signal.

Referring specifically to FIG. 5, D-type master-slave flip-flops 4 and 5, are provided with a minus trigger, and in combination with AND gates 7 and 8, NAND gate 14 and NOR gate 15 comprise a divider circuit for dividing the signal SEL* by ½ or ⅓ in order to produce the timekeeping select signals $SL_1$ through $SL_3$. D-type master-slave flip-flop 6, also provided with a minus trigger, comprises a ½ divider circuit for controlling the changeover between the main-display channel and the sub-display channel. Because of the minus trigger of the D-type flip-flops 4, 5 and 6, the reset signals applied thereto are not HIGH level signals and, instead, flip-flops 4 through 6 are reset in response to a LOW level reset signal being applied thereto.

The remaining elements of the mode select circuit, depicted in FIG. 5, will be explained in the context of the operation thereof.

In operation, when the signal LOCK is a LOW level signal, a changeover circuit comprised of inverter $I_1$, inverter $I_2$, NOR gate 17, NOR gate 18 and OR gate 11, determines the state of the changeover signal LEAD. Specifically, since the LOCK signal is a LOW level signal, the inverter $I_2$ will apply, as a first input to NOR gate 17, a HIGH input, to thereby produce, at the input of OR gate 11, a low level input. However, the LOW level LOCK signal is also applied to a first input of NOR gate 18, and accordingly, if a further LOW level signal were to be applied to the other input of the NOR gate 18, a HIGH level signal would, in turn, be applied to the OR gate 11 and thereby change the changeover signal LEAD to a HIGH level. Thus, when a LOW level control signal SEL is applied through inverter $I_1$, and is inverted thereby, a LOW level changeover signal LEAD is provided. However, when the push button 2 is actuated, the LOCK signal remains at a LOW level, and the signal SEL is a HIGH level signal. This, in turn, will result in the changeover signal LEAD being a HIGH level signal and thereby effecting the selection of the sub-display channel instead of the main-display channel.

When the correction-locking switch 1 is pushed in, D-type flip-flops 4, 5 and 6 are reset by the LOW level signal applied thereto. However, when the correction-locking switch 1 is pulled out, the LOCK signal becomes a HIGH level signal thereby releasing the D-type flip-flops 4 through 6, and coincident with the release of the D-type flip-flops 4 through 6, causes the changeover signal to be controlled by the output $\overline{Q3}$ of the flip-flop 6. This occurs because the HIGH level LOCK signal is applied through inverter $I_2$ to a first input of NOR gate 17 as a LOW level signal, thereby causing NOR gate 17 to produce a HIGH level output signal when the output $\overline{Q}_3$ of flip-flop 6 is a LOW level signal. Additionally, the HIGH level LOCK signal is applied to the first input of NOR gate 18, thereby insuring that the output thereof will remain a LOW level signal until the LOCK signal is returned to a LOW level signal. Thus, the changeover, signal LEAD is controlled by the output $\overline{Q}_3$ of the flip-flop 6.

The divider circuit comprised of flip-flops 4 and 5, AND gates 7 and 8, NOR gate 15 and NAND gate 14, provides a division ratio of ⅓ or ½, the division ratio being determined by the output $Q_3$ of the D-type flip-flop 6. For example, when the output $Q_3$ is a LOW level signal, the output $\overline{Q}_3$ is a HIGH level signal, thereby producing a LOW level LEAD signal and, hence, a selection of the main-display channel. Moreover, the LOW level output $Q_3$ of the flip-flop 6 disposes the divider circuit formed by flip-flops 4 and 5 into a ⅓ divider. However, when the output $Q_3$ is a HIGH level signal, the divider circuit formed by flip-flops 4 and 5 will become a ½ divider circuit.

Accordingly, when the correction-locking switch 1 produces a HIGH level LOCK signal, the output $Q_3$ is a LOW level signal, thereby, as detailed above, causing the changeover signal LEAD to be a LOW level signal and to effect a selection of the main-display channel. Moreover, the divider circuit of the flip-flops 4 and 5 operate as a ⅓ divider circuit. Therefore, the output $Q_1$ and $Q_2$ are indexed by a count of one for each pushing of the control button 2 in response to the signal SEL* being applied to the clock terminals CL of the flip-flops 4 and 5. Thus, as illustrated in FIG. 6, in response to each pushing of the control push button 2, the outputs $Q_1$ and $Q_2$ will first produce a HIGH level timekeeping counter select signal $SL_1$, upon the next pushing of control push button 2, a timekeeping counter select signal $SL_2$, and upon a third actuation of control push button 2, a HIGH level timekeeping counter select signal $SL_3$, to thereby effect a sequential selection of the seconds timekeeping counter, minutes timekeeping counter and hours timekeeping counter.

Figure 10:
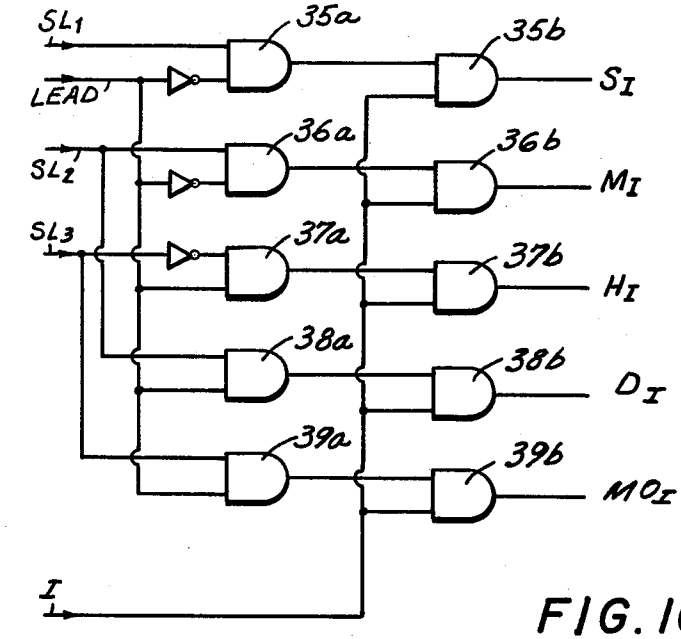
FIG. 10 is a detailed circuit diagram of a timekeeping counter selecting circuit adapted for use with the mode select circuit depicted in FIG. 5.

Referring to FIG. 10, the manner in which the signals produced by the mode select circuit depicted in FIG. 5 including the timekeeping counter select signals $SL_1$, $SL_2$ and $SL_3$, in combination with the changeover signal LEAD effect a sequential selection of the timekeeping counters to be corrected, is depicted. The counter select circuitry includes AND gates 35*a*, 36*a*, 37*a*, 38*a* and 39*a*, each having two inputs and AND gates 35*b*, 36*b*, 37*b*, 38*b* and 39*b* also having two inputs. A first input of each AND gate 35*a* through 39*a* is the timekeeping counter select signal $SL_1$, $SL_2$ and $SL_3$. The second input to each of the AND gates 35*a* through 39*a* is a changeover signal LEAD, which signal determines whether signal $SL_1$, $SL_2$ or $SL_3$ will be transmitted by gates 35*a* through 37*a* as a first input to AND gates 35*b* through 37*b*, respectively, or alternatively, whether signals $SL_2$ and $SL_3$ will be transmitted through gates 38*a* and 39*a* as first inputs to AND gates 38*b* and 39*b*, respectively. A correction pulse signal I is selectively applied to the second input of AND gates 35*b* through 39*b* by actuating correction push button 3. It is noted however that if an intermediate frequency signal, on the order of 8 Hz produced by a divider stage in the divider circuitry is utilized as the correction signal I, a rapid advance type of correction of each of the timekeeping counters could be effected, instead of the indexing pulse signal type correction arrangement discussed above. It is noted that both types of correction, indexing of the count of the counter by applying a pulse signal and rapid advancing by utilizing an intermediate frequency signal, as well known in the art and are equally suitable for use with the instant invention. As noted above, the changeover signal LEAD is a LOW level signal, one of the AND gates 35*a*, 36*a* or 37*a* will be selected. Alternatively, when the changeover signal LEAD is a HIGH level signal, AND gate 38*a* or 39*a* will be selected. As an example of the manner in which selection of the timekeeping counter to be corrected results, if timekeeping counter select signal $SL_2$ is a HIGH level signal and channel select signal LEAD is a LOW level signal, HIGH level timekeeping counter select signal $SL_2$ will be transmitted through AND gate 36*a* to a first input of AND gate 36*b*. If a correction signal I is applied to the other input of AND gate 36*b*, a minutes correction signal MIN. will be applied through correction gate 48 of minutes counter 47 to thereby effect correction thereof.

If the control push button 2 is actuated, after the hours counter has been selected, the LOW level signal SEL* is applied to the respective clock inputs CL of flip-flops 4 and 5, thereby changing the output $Q_1$ of flip-flop 4 from a HIGH to a LOW level. However, since the clock input CL of flip-flop 6 is the output $Q_1$ from flip-flop 4, the output $\overline{Q}_3$ is inverted from a HIGH to a LOW level, thereby inverting the changeover signal LEAD from a LOW level signal to a HIGH level signal to thereby effect the display of the sub-display channel. Moreover, since the output $\overline{Q}_3$ of flip-flop 6 is inverted to a LOW level signal, the output of AND gate 9 becomes a LOW level signal, thereby effecting a resetting of flip-flop 5 and converting the divider circuit formed by flip-flop 4 and flip-flop 5 into a $\frac{1}{2}$ divider circuit. Accordingly, the digit selected for correction becomes the day digits initially, and upon an actuation of control push button 2 the month digits $Q_1$ becomes a HIGH level signal upon the actuation of the push button 2. If the push button 2 is again pushed, at this time, the output $Q_1$ from flip-flop 4 is inverted from a HIGH to a LOW level at the same time that the output $Q_3$ from flip-flop 6 is inverted from a HIGH level to a LOW level thereby causing the changeover signal LEAD to become a LOW level signal and for the timekeeping counter select signal $SL_1$ to become a HIGH level signal and, once again, select the seconds timekeeping counter as the counter to be corrected. Accordingly, the mode select circuit of FIG. 5 effects the cyclical and sequential selection of the seconds counter, minutes counter, hours counter, day counter and month counter and thereafter the seconds counter to start a further cycle, when the mode select circuit is in a correction mode, in response to each actuation of control push button 2.

Reference is now made to FIG. 4, where a table, illustrating the manner in which the mode select circuits illustrated in FIG. 5, effect changeover of the display when the timepiece is in a timekeeping mode, and additionally, correction of each of the timekeeping counters associated with the main-display channel and the sub-display channel are effected, like reference numerals and designations to those utilized in FIG. 3 being utilized to illustrate the operation of the instant invention. Accordingly, the instant invention utilizes the same number of switches as the prior art timepiece illustrated in FIG. 1, and permits each of the timekeeping counters, producing a timekeeping signal, to be selected and corrected when the timepiece is disposed in a correction mode, without first having to return the timepiece to either a locked position or a changeover mode.

Figure 7:
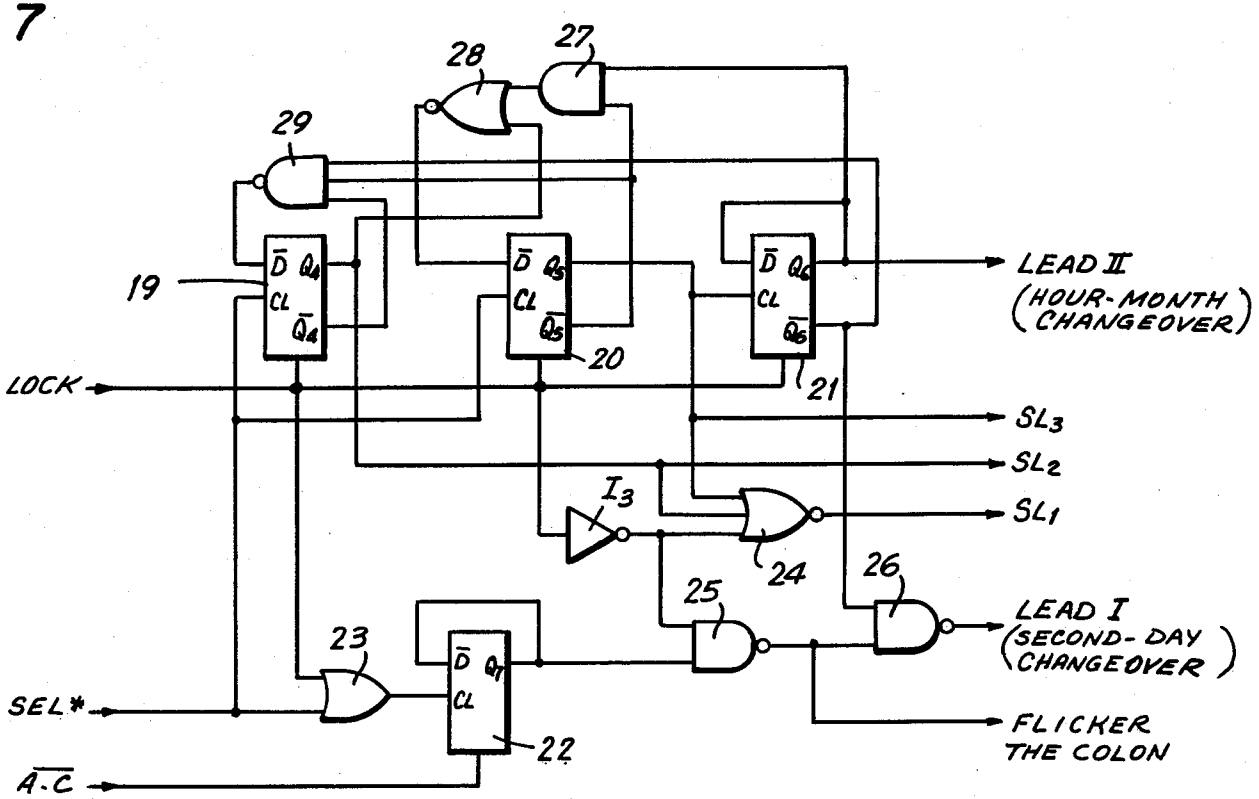
FIG. 7 is a circuit diagram of a mode select circuit constructed in accordance with a further embodiment of the instant invention.
Figure 8:
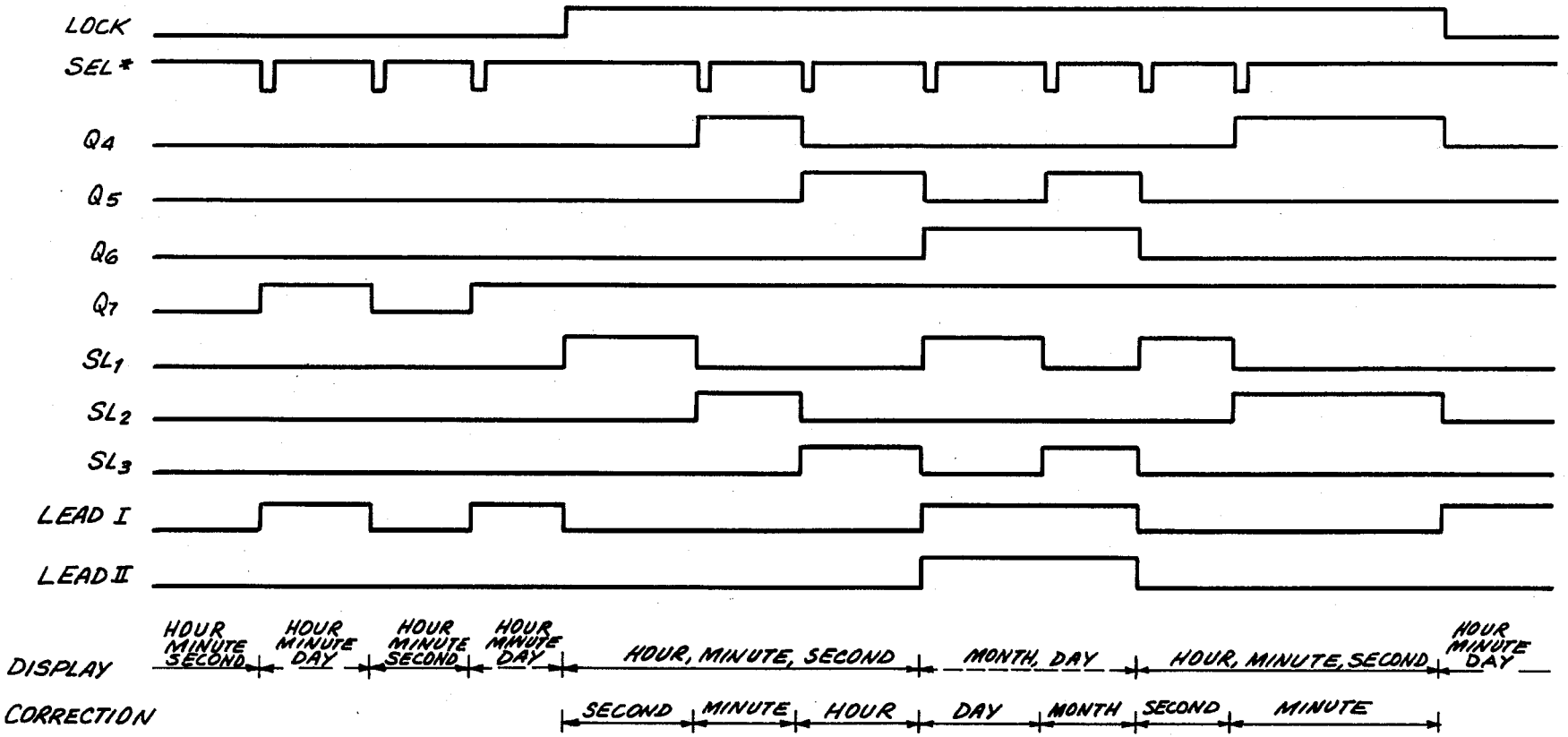
FIG. 8 is a comparative wave diagram illustrating the operation of the mode select circuit depicted in FIG. 7.

Reference is now made to FIGS. 7 and 8, wherein a mode select circuit and comparative wave diagrams, illustrating the operation thereof, are depicted, like reference numerals and designations being utilized to denote like elements and functions detailed above. Signal LEAD I is a changeover signal for changing over the seconds display to a day display. Seconds are displayed when the control signal LEAD I is a LOW level signal, and the day is displayed when the LEAD I is a HIGH level signal. A second control signal LEAD II can be utilized as a control signal for changing over the hour, minute and second display to a month, hour and day display during correction. For example, hours, minutes and seconds are displayed when the second changeover signal LEAD II is a LOW level signal and the day and month is displayed when the second control signal LEAD II is a HIGH level signal. Thus, the second changeover signal LEAD II is utilized to suppress the seconds, minutes and hours display when same is a HIGH level signal during correction. D-type flip-flops 19 and 20, NAND gate 29, NOR gate 28 and AND gate 27 define a $\frac{1}{3}$ and $\frac{1}{2}$ divider circuit in the same manner described above with respect to flip-flops 4 and 5, with the signal applied to the clock terminal CL thereof being the signal SEL* obtained in response to the operation of the push button 2. Additionally, Inverter $I_3$ and NOR gate 24 are utilized to produce timekeeping counter select signal $SL_1$. Timekeeping counter select signals $SL_2$ and $SL_3$ are the outputs $Q_4$ and $Q_5$, respectively, of flip-flops 19 and 20. D-type flip-flop 21 forms a $\frac{1}{2}$ divider circuit and receives the output $Q_5$ of flip-flop 20 as its clocked input. The output $Q_6$ is utilized to control the division ratio of the divider circuit comprised of flip-flops 19 and 20. The outputs $Q_6$ and $\overline{Q}_6$ of flip-flop 21 control the level of the first and second changeover signals LEAD I and LEAD II when the mode select circuit is disposed in a correction mode by the correction-locking switch applying a HIGH level LOCK signal thereto. It is noted however, that in the timekeeping mode, the flip-flops 19 through 21 are reset by the LOW level LOCK signal, and the flip-flop 22 is utilized to control the output LEAD I, to permit same to effect a changeover from a display of the main-display channel to the sub-display channel in response to a pushing of control switch 2. Accordingly, like the mode select circuit depicted in FIG. 5, sequential and cyclical selection of the timekeeping counter to be corrected is effected in response to each actuation of push button 2, when the timepiece is in a correction mode, and the display is automatically changed over from a main-display channel to a sub-display channel when the timekeeping counter, associated with the digit of time in the particular channel, is selected.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic timepiece including, time standard means for producing a time standard signal; a plurality of series-connected counter means for receiving said time standard signal, each of said series-connected counter means being adapted to produce a timekeeping signal representative of the count thereof; digital display means adapted to display a first type of time information in response to at least two of said timekeeping signals produced by first and second series-connected counter means being applied thereto, said digital display means being further adapted to display a second type of information in response to at least one further timekeeping signal produced by a third series-connected counter means being applied thereto; and display select means disposed intermediate said series-connected counter means and said digital display means, said display select means being normally disposed in a first display mode and selectively disposable into a second display mode in response to a changeover signal being applied thereto, said display select means being adapted in a first display mode to apply to said digital display means said at least two timekeeping signals produced by said first and second series-connected counter means, and being further adapted in a second display mode to apply to said digital display means said at least one further timekeeping signal produced by said third counter means, the improvement comprising; control means for selectively producing a control select signal; adjustment means for producing an adjustment signal; and mode select means disposed intermediate said control means and said series-connected counter means and display select means, said mode select means being coordinately disposable between a first mode and a second mode, said mode select means being adapted, when disposed in said first mode, to apply to said display select means a changeover signal in response to said control select signal being selectively applied thereto, said mode select means including counter select means for cyclicly selecting in sequence at least said first, second and third series-connected counter means in response to each selective application of a control select signal, when the mode select means is disposed in a second mode, said counter select means being further adapted when disposed in a second mode to produce said changeover signal in response to selection of said third series-connected counter means and to produce at least first and second counter means selecting signals in response to said control select signal being selectively applied thereto, and gating means disposed intermediate said counter select means and at least said first, second and third series-connected counter means, said gating means, in response to receiving one of said first and second counter select signals, being adapted to select one of said first and second counter means to receive said adjusting signal, said gating means being further adapted, in response to coincidentally receiving one of said first and second counter select signals and said changeover signal, to select said third counter means to receive said adjustment signal.

2. An electronic timepiece as claimed in claim 1, wherein said mode select means includes manually operated mode switch means at least coordinately displaceable between a changeover position to dispose said mode select means in said first mode and a correction position to dispose said mode select means in a second mode.

3. An electronic timepiece as claimed in claim 2, wherein said control means includes manually actuatable switch means adapted to produce a control pulse signal in response to each actuation thereof, each said control pulse signal effecting application of a changeover signal to said display select means when said mode switch means is disposed in a changeover position, the application of each said control pulse signal further effecting a selection of a different one of said first, second and third counter means when the mode switch is disposed in a correction position.

4. An electronic timepiece as claimed in claim 3, wherein said adjustment means includes a manually actuatable means for selectively applying to said counter means selected by said counter select means a correction adjustment signal for changing the count of the counter means to which the correction adjustment signal is applied.

5. An electronic timepiece as claimed in claim 3, wherein said counter select means includes divider means for receiving each control pulse signal produced by said manually actuatable control switch means when said mode select circuit is disposed in a second mode, said divider means in response thereto producing at least first and second counter select signals, in sequence, and cycle means for detecting said at least first and second counter select signals produced in sequence by said divider means and defining a first half-cycle in response thereto, said cycle means being adapted to reset said divider means in response to the next control pulse signal applied thereto at the end of said first half-cycle to return the divider means to the beginning of the sequence and thereby produce at least one of such first and second counter select signals and simultaneously therewith a changeover signal in a next half-cycle, said gating means being disposed intermediate the divider and cyclic means and the series-connected counter means, said gating means in response to receiving one of said first and second counter select signals in said first half-cycle, being adapted to select one of said first and second counters to receive said adjusting signal, said gating means being further adapted, in response to coincidentially receiving one of said first and second counter select signals and said changeover signal in said next half-cycle, to select said third counter means to receive said adjusting signal.

6. An electronic timepiece as claimed in claim 5, and including fourth series-connected counter means disposed intermediate said second series-connected counter means and said third series-connected counter means for producing a third time-keeping signal representative of a first type of information, and fifth series-connected counter means coupled to said fourth series-connected counter means for producing a timekeeping signal representative of a second type of information, said divider means being adapted to apply at least first, second and third counter select signals to said gating means for selecting in sequence said first, second and fourth counter means to receive adjustment signals and first and second counter select signals in coincidence with said changeover signal to select in sequence said third and fifth counter means for receiving said adjustment signal.

7. An electronic timepiece as claimed in claim 6, wherein said divider means is provided with a variable division ratio when said mode select means is in a second mode, characterized by a first division ratio of $\frac{1}{3}$ during the first half-cycle of said divider means for producing in sequence said first, second and third counter select signals and a $\frac{1}{2}$ division ratio in said second half-cycle for producing in sequence at least two of said first, second and third counter select signals.

8. In an electronic timepiece including time standard means for producing a time standard signal; a plurality of seriesconnected counter means for receiving said time standard signal, each of said series-connected counter means being adapted to produce said timekeeping signal representative of the count thereof; the improvement comprising digital display means adapted to display a first type of time information in response to at least two of said timekeeping signals produced by first and second series-connected counter means being applied thereto, said digital display means being further adapted to display a second type of information in response to at least one further timekeeping signal produced by a third series-connected counter means being applied thereto, said digital display means being adapted to display a third type of information in response to timekeeping signals produced by said third series-connected counter means and a fourth series-connected counter means being applied thereto; and display select means disposed intermediate said series-connected counter means and said digital display means, said display select means being normally disposed in a first display mode and selectively disposable into a second display mode in response to a first changeover signal being applied thereto, said display select means being selectively disposable from said first display mode into a third display mode in response to a second changeover signal being applied thereto, said display select means being adapted in a first display mode to apply to said digital display means said at least two timekeeping signals produced by said first and second series-connected counter means, said display select means being adapted in a second display mode to apply to said digital display means at least said one further timekeeping signal produced by said third counter means and said display select means being adapted in a third display mode to apply to said digital display means said one further timekeeping signal produced by said third counter means and an additional timekeeping signal produced by said fourth counter means, control means for selectively producing one of a first and second control select signal; adjustment means for producing an adjustment signal; and mode select means disposed intermediate said control means and said first, second, third and fourth counter means and said display select means, said mode select means being coordinately disposable between a first mode and a second mode in response to said first control select signal being applied thereto, said mode select means being adapted when disposed in said second mode, to apply to said display select means a first changeover signal in response to said first control select signal being selectively applied thereto, said mode select means being adapted when disposed in said third mode to cyclicly select in sequence said first, second, third and fourth counter means to be adjusted by said adjusting signal in response to each selective application of said second control select signal when the mode select means is disposed in a third mode, said counter select means being adapted to apply to said display select means a second changeover signal in response to selection of said third and fourth series-connected counter means, when said mode select means is disposed in said third mode.

9. An electronic timepiece as claimed in claim 8, wherein said first and second timekeeping signals are representative of present time and said third and fourth timekeeping signals produced by said third and fourth counter means are representative of calendar information.

10. An electronic timepiece as claimed in claim 9, wherein said fourth timekeeping signal produced by said fourth counter means is representative of the month.

11. In an electronic timepiece including time standard means for producing a time standard signal; a plurality of seriesconnected counter means for receiving said time standard signal, each of said series-connected counter means being adapted to produce said timekeeping signal representative of the count thereof; the improvement comprising digital display means including first and second display digit means adapted to respectively display first and second types of time information in response to first and second timekeeping signals respectively produced by first and second series-connected counter means being applied thereto, said first display digit means being further adapted to display a third type of time information in response to a timekeeping signal produced by a third series-connected counter means being applied thereto, said second display digit means being adapted to display a fourth type of information in response to timekeeping signals produced by a fourth series-connected counter means being applied thereto; and display select means normally disposed to perform a timekeeping operation and being adapted to be selectively disposed to perform a correction operation, said display select means being disposed intermediate said series-connected counter means and said first and second display digit means, said display select means during the timekeeping operation being disposable between a first display mode and a second display mode, said display select means also being disposable between a first display mode and a third display mode only when performing a correction operation, said display select means being adapted in a first display mode to respectively apply to said first display digit means and second display digit means said first and second timekeeping signals produced by said first and second series-connected counter means, said display select means being adapted in a second display mode to apply to said first digital display means said third timekeeping signal produced by said third series-connected counter means and said display select means being adapted in a third display mode to apply to said first display digit means and said second display digit means said third timekeeping signal produced by said third counter means and said fourth timekeeping signal produced by said fourth counter means, said display select means being adapted when performing a correcting operation to be first disposed in a first display mode and thereafter in a third display mode to cyclicly select in sequence said first, second, third and fourth counter means to be corrected.

12. An electronic timepiece as claimed in claim 11, wherein said first and second series-connected counter means produce timekeeping signals representative of elapsed time, said third counter means is adapted to produce timekeeping signals representative of data information, and said fourth counter means is adapted to produce timekeeping signals representative of month information.

* * * * *